US006248273B1

(12) United States Patent
Benin et al.

(10) Patent No.: US 6,248,273 B1
(45) Date of Patent: Jun. 19, 2001

(54) SPINNING CELL AND METHOD FOR DRY SPINNING SPANDEX

(75) Inventors: Joshua Benin, Newark, DE (US); Gary L. Caldwell, Ashville, NC (US); George W. Goldman, West Chester, PA (US); Charles S. Huffer, Churchville, VA (US); Gang Jin, Wilmington, DE (US); James F. McKinney, Waynesboro, VA (US); William M. Ollinger, Taipei (TW); Jerzy Spolnicki, Fisherville; David A. Wilson, Waynesboro, both of VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/367,035

(22) Filed: Aug. 5, 1999

Related U.S. Application Data

(60) Provisional application No. 60/038,182, filed on Feb. 13, 1997.

(51) Int. Cl.[7] ..... D01D 4/02; D01D 5/04; D01F 6/78

(52) U.S. Cl. ..... 264/101; 264/205; 264/211.12; 264/211.17; 425/72.2; 425/377; 425/378.2; 425/382.2; 425/464

(58) Field of Search ..... 264/101, 205, 264/211.12, 211.17; 425/72.2, 377, 378.2, 382.2, 464

(56) References Cited

U.S. PATENT DOCUMENTS 3,737,508 * 6/1973 Weir .
3,847,522 * 11/1974 Heckrotte et al. .
4,283,364 * 8/1981 Capps et al. .
4,431,602 * 2/1984 Behrens et al. .
4,679,998 * 7/1987 Dreibelbis et al. .
4,804,511 * 2/1989 Pieper et al. .
5,387,387 * 2/1995 Alexander et al. .

* cited by examiner

*Primary Examiner*—Leo B. Tentoni
(74) *Attorney, Agent, or Firm*—George A. Frank

(57) ABSTRACT

A spinning cell for dry spinning spandex by extruding filaments from a nonuniform array of spinneret capillary groups in a rectangular bar and contacting them with a cross-flow of hot, inert gas is provided.

8 Claims, 4 Drawing Sheets

SPINNING CELL AND METHOD FOR DRY SPINNING SPANDEX

REFERENCE TO RELATED APPLICATIONS

This is a continuation-in-part application of provisional application U.S. 60/038,182, filed Feb. 13, 1997.

BACKGROUND OF THE INVENTION

1. Field of the Invention

The invention relates to dry spinning spandex yarns and, more particularly, it relates to a rectangular spinning cell for dry spinning spandex.

2. Description of the Background Art

One method of making spandex is to dry-spin it from a solvent which is evaporated from the threadline by a hot, inert gas. As disclosed in U.S. Pat. Nos. 3,737,508, 4,431,602, 4,679,998 and 4,804,511, this method generally employs an upright heated tube (spin cell), spinnerets at the top end of the tube through which the solution is introduced into the spin cell, a hot inert gas which evaporates the solvent as it contacts the threadlines in the tube, and removal of the spandex filaments from the bottom of the spin cell.

Research Disclosure No. 34866, April 1993, describes a variety of apparatus configurations for dry-spinning synthetic fibers including spandex. FIGS. 10*a* through 10*f* depict different spinneret hole arrangements including circular and uniform linear capillary arrays. FIGS. 1 through 9 depict different capillary arrangements for introducing the gas into the cell.

James et al., U.S. Pat. No. 5,387,387, disclose advantages of a uniform, linear array of spinneret capillary groups over a circular arrangement for dry spinning spandex. In this method, a hot, inert gas is distributed about the spinnerets and flows down the spin cell cocurrently with the threadlines. The spinnerets can be arranged in one row or more than one row and each row can be staggered within each linear configuration as illustrated in FIGS. 2 and 3 of the '387 patent. However, with cocurrent feed of the hot, inert gas, the gas penetration into the filament bundles is poor, and solvent is not effectively removed from the filament bundles. Such deficiencies produce filaments having non-uniform physical properties such as tenacity and load power. The filaments closer to the gas feed have properties which differ from those of the filaments further from the gas feed.

The highly regular, uniform arrangements disclosed in the prior art make spandex which is unsatisfactorily nonuniform along its length, and a practical arrangement is still desired.

SUMMARY OF THE INVENTION

The spinning cell of this invention for dry-spinning spandex comprises:

(A) a substantially rectangular, adiabatically controlled shaft;

(B) a top plenum in a wall of the shaft for providing a cross-flow of hot inert gas; and (C) a substantially rectangular bar containing groups of spinneret capillaries mounted atop the shaft and having short axis, a long axis, and a nonuniform array of spinneret capillary groups in which a first row and a second row of capillary groups are in staggered relationship to each other, the first row being closer to the top plenum than the second row, wherein the capillary groups in each row deviate from a uniform linear arrangement in that:

(i) the first row comprises two more capillary groups than the second row;

(ii) the second row is divided into two segments by omitting one capillary group therein adjacent to the short axis of the bar;

(iii) at least two of the capillary groups at each end of the first row are offset toward the long axis of the bar;

(iv) at least one capillary group at each end of the second row is offset toward the long axis of the bar; and (v) at least one capillary group at each end of the first row is offset toward the short axis of the bar.

The method of this invention for dry-spinning spandex comprising the steps of:

(a) pumping a heated solution containing polyurethane through a nonuniform array of spinneret capillary groups in a substantially rectangular bar to extrude filaments;

(b) contacting the extruded filaments with a cross-flow of hot, inert gas introduced through a top plenum into an upper portion of an adiabatically controlled, substantially rectangular shaft;

(c) removing the filaments through an exit guide at the bottom of the shaft; and (d) winding the spandex on cores to form packages;

wherein the bar contains groups of spinneret capillaries and is mounted atop the shaft and has a short axis, a long axis, and a nonuniform array of spinneret capillary groups in which a first row and a second row of capillary groups are in staggered relationship to each other, the first row being closer to the top plenum than the second row, wherein the capillary groups in each row deviate from a uniform linear arrangement in that:

(i) the first row comprises two more capillary groups than the second row;

(ii) the second row is divided into two segments by omitting one capillary group therein adjacent to the short axis of the bar;

(iii) at least two of the capillary groups at each end of the first row are offset toward the long axis of the bar;

(iv) at least one capillary group at each end of the second row is offset toward the long axis of the bar; and (v) at least one capillary group at each end of the first row is offset toward the short axis of the bar.

DETAILED DESCRIPTION OF THE INVENTION

As used herein, spandex has its customary meaning, that is, a manufactured fiber in which the fiber-forming substance is a long chain synthetic elastomer comprised of at least 85% by weight of a segmented polyurethane. Spandex is generally dry-spun from solutions of polyurethane or polyurethaneurea in solvents such as dimethylacetamide, dimethylformamide, N-methylpyrrolidone, dimethyl sulfoxide. The polymers can be prepared by capping a polymeric diol such as a polyether, polyester or polycarbonate glycol with a diisocyanate and then chain-extending the resulting capped glycol with one or more diamines or diols.

The spinning cell of this invention for dry-spinning solutions of polyurethane or polyurethaneurea to make spandex and the process for using the spinning cell provide increased productivity and improved uniformity in the physical properties of the resulting spandex.

Figure 1:
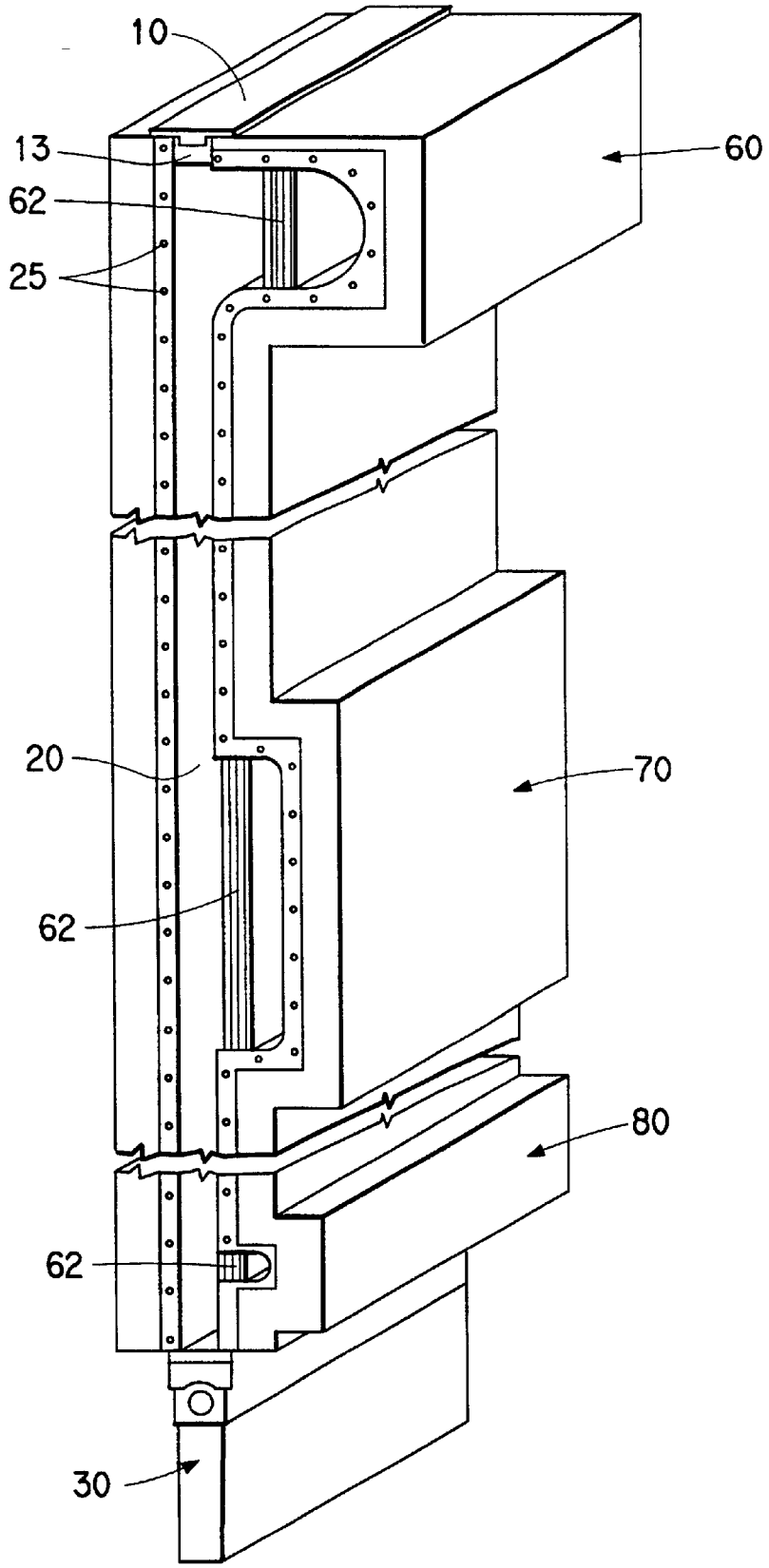
FIG. 1 is an isometric side-view section of the major components of the spinning cell of the present invention.

Turning first to FIG. 1, a solution of polyurethane, which can be a polyurethane or a polyurethaneurea, is pumped to bar 13 through a solution heater 10, which is mounted atop rectangular shaft 20. Shaft 20 is substantially rectangular, has suitable heating elements 25 and can be insulated. The heating elements and insulation are arranged and adjusted so as to obtain adiabatic control throughout the length of the shaft and to compensate for heat loss through the short sides (ends) of the rectangular shaft. More heat is applied at the top of the shaft than at the middle or bottom. Heat is applied to all four sides of the shaft. Below solution heater 10, hot inert gas is introduced from top plenum 60 into an upper portion of shaft 20 through an opening in its wall. Then, laden with solvent evaporated from the dry-spun filaments, the hot gas is withdrawn-from shaft 20 into vacuum plenum 70 through an opening in the wall of the shaft. Bottom plenum 80, located in the wall of the shaft above lower closure section 30 and below vacuum plenum 70, provides an up-flow of cooler inert gas, countercurrent to the direction of motion of the filaments. The up-flowing gas also exits shaft 20 through the opening in its wall that leads to vacuum plenum 70. Screen and diffuser assemblies 62 can aid in minimizing gas turbulence. Low gas turbulence in the spin cell can help to provide more uniform spandex properties. The pressure inside the shaft can be adjusted to minimize escape of solvent from the spinning cell.

Figure 2:
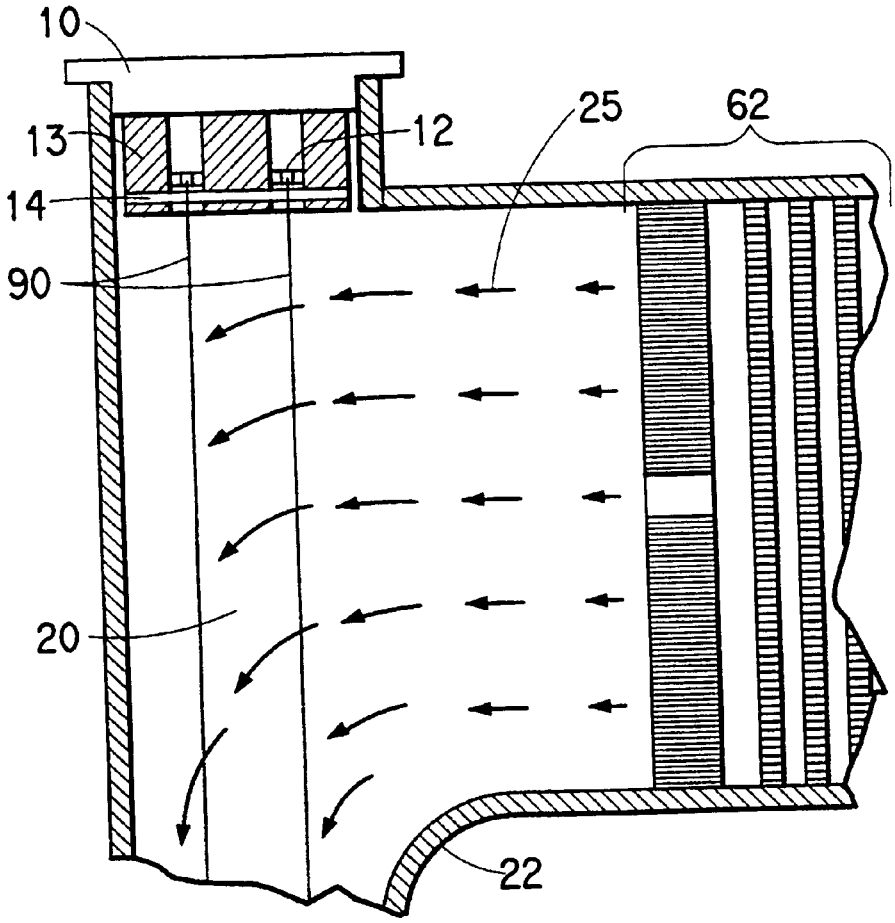
FIG. 2 shows in greater detail and in cross section the upper portion of the spinning cell of FIG. 1, including capillary groups and hot inert gas entry.

FIG. 2 shows the upper portion of the spinning cell in cross-section, taken across the short axis of the substantially rectangular bar 13 containing groups of spinneret capillaries and shaft 20. The polymer solution is extruded through spinneret capillary groups 12 in bar 13 to form one or more rows of filaments 90. Two rows are illustrated and are preferred. Filaments 90 travel vertically downward from the capillary groups through corresponding holes in heat shield 14 into shaft 20. Just below heat shield 14, filaments 90 are met by a cross-flow of hot inert gas. The gas, after passage through an assembly 62 of screens and diffusers in top plenum 60 (see FIG. 1), is introduced to shaft 20 through one wall of the shaft in a substantially laminar and uniformly distributed flow. In the shaft, the direction of hot gas flow changes from cross-flow to co-current flow, with respect to the direction of motion of filaments 90. Short arrows 25 in FIG. 2 indicate the approximate direction of gas flow. The part of the shaft wall indicated at 22 can be designed to minimize turbulence, for example by making it a Coanda shape, providing curved flow transition to prevent flow separation. Turbulence can also be minimized by profiling gas flow wherein gas velocity is near zero at the bottom and increases linearly away from the surface up to a point after which the velocity remains substantially constant.

Figure 3A:
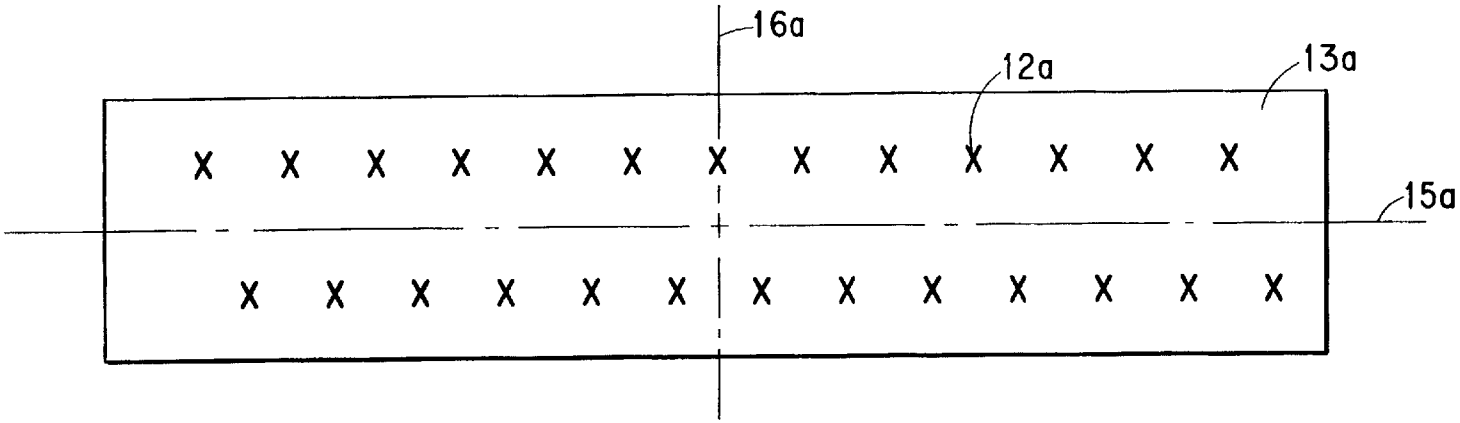
FIG. 3A (PRIOR ART)
FIG. 3A illustrates an array of capillary groups outside of this invention.
Figure 3B:
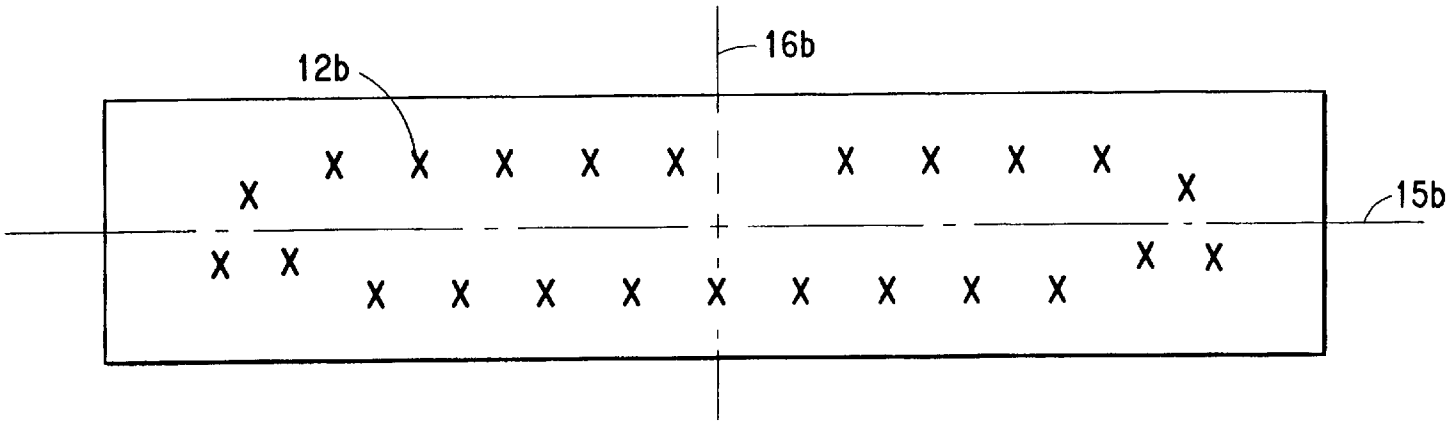
FIG. 3B illustrates the face of the bar 13 and spinneret capillary groups 12, showing an array of capillary groups of this invention.

The arrangement of the spinneret capillary groups is shown in FIG. 3B. The spinneret capillary groups in each row deviate from a uniform linear arrangement in the bar, as shown. It has been found surprisingly that such an arrangement provides substantial beneficial effects on the uniformity of the spandex produced with the spinning cell and the process of this invention.

The uniform arrangement of the prior art is shown in FIG. 3A. The spinneret capillary groups in FIG. 3A are arranged in one or more rows which are parallel and have an equal number of capillary groups 12*a*. Two rows are illustrated. The capillary groups are equally spaced in the rows. The rows are equidistant from long axis 15*a* of the bar 13*a*. The capillary groups in each row are staggered in relation to the capillary groups in the other row. The outline of the resulting array of the capillary groups is a parallelogram.

Surprisingly and unexpectedly, considerable improvement in the uniformity of the resulting spandex is achieved from the arrangement of the spinneret capillary groups of this invention. Referring now to FIG. 3B, it can be seen that one spinneret capillary group has been omitted from the end of one row so that the rows have unequal numbers of spinneret capillary groups 12*b*, and the outline of the array of capillary groups is a trapezoid. The first row, with the larger number of capillary groups, is positioned closer to the opening in the wall of shaft 20 through which the hot inert gas is introduced. The second row of capillary groups farther from the gas entry opening, has the fewer capillary groups.

In addition, the shorter row (eleven spinneret capillary groups are exemplified in the short row of FIG. 3B) has been divided into two segments, one containing six substantially equally spaced capillary groups, and the other containing five substantially equally spaced capillary groups, by omitting one capillary group adjacent to the short axis 16*b*. The result is an array of capillary groups of two rows in which one row has two more capillary groups than the other row, the shorter row having a gap therein.

Further, the capillary groups near the ends of each row are offset toward long axis 15*b* of the bar. For example, at least one of the capillary groups at each end of the row of eleven and at least two of the capillary groups at each end of the row of thirteen are so offset. In addition, at least the group of capillaries at each end of the row of thirteen are offset toward short axis 16*b*.

Two rows of thirteen and eleven groups of capillaries, respectively, are exemplified in FIG. 3B, but more or fewer such groups can be used. The "x" is an indication of location of a group of capillaries. For example, rows of nine and eleven, fifteen and seventeen, and twenty-three and twenty-five groups of capillaries each can be used in the spinning cells and the process of this invention. In each case, the total number of capillary groups is an even number.

Each group of capillaries can comprise a single capillary or a plurality of capillaries grouped together, depending on the decitex desired in the final spandex. As a practical matter, up to 15 capillaries within a group of capillaries can be envisioned. Even for the same desired decitex, the number of capillaries, and their relative positioning within a group, can vary depending on desired yarn properties and the needs of solvent removal from the filaments.

The use of grouped capillaries leads to the formation of multiple fibers; these are combined near the bottom of the shaft by coalescence jets. The distance between the capillaries within a group can be varied according to the group's position in the row of capillary groups. Referring to FIG. 3B, for example, the two groups of capillaries at each end of the row of eleven and the three groups of capillaries at each end of the row of thirteen have the shortest distance among the capillaries within each group, compared to all the intercapillary distances in all the groups. The seven groups of capillaries in the mid-section of the row of thirteen have an intermediate distance among capillaries within each group, and the seven groups of capillaries in the mid-section of the row of eleven have the longest distance among capillaries within each group.

Figure 4:
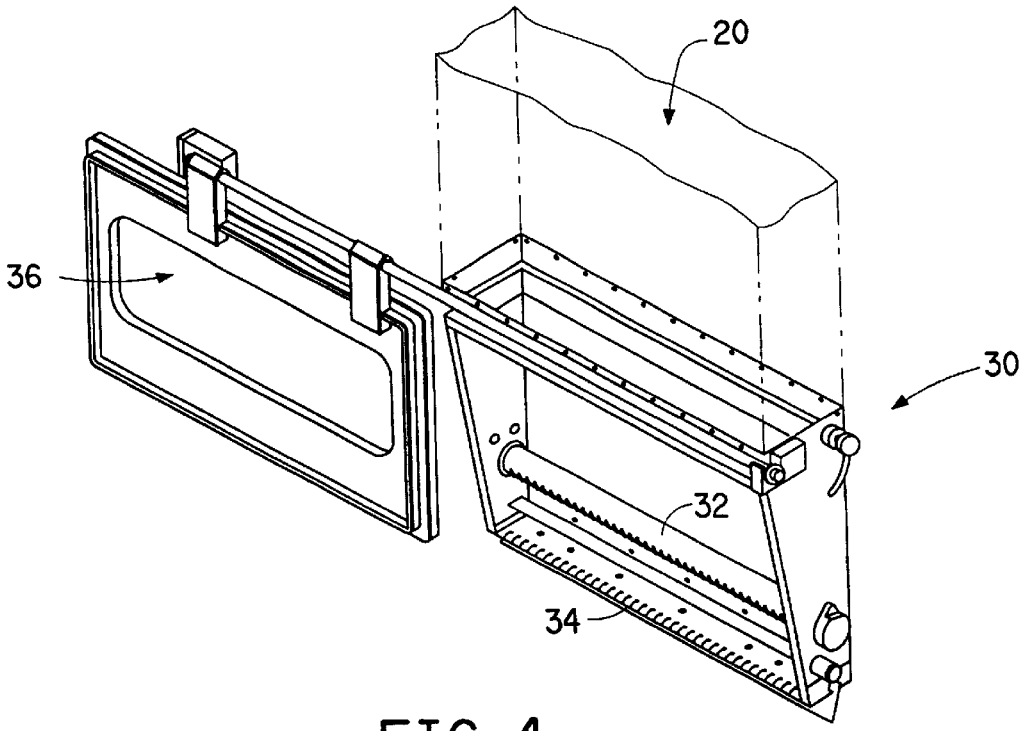
FIG. 4 is an isometric drawing of the converging lower closure section of the spinning cell of this invention.
Figure 5:
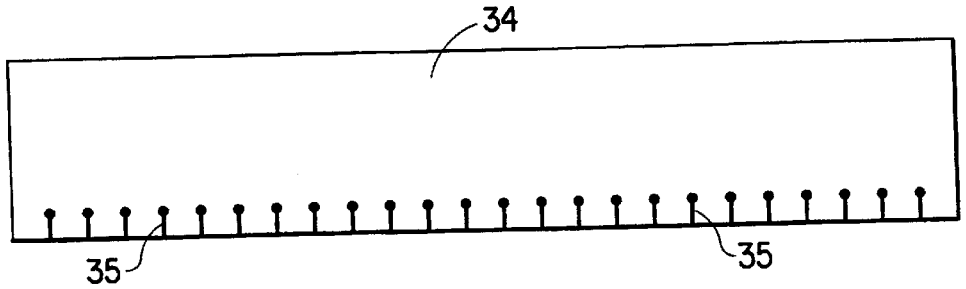
FIG. 5 illustrates the face of the filament exit guide in the lower closure section of this invention.

Turning now to FIG. 4, lower closure section 30, which houses coalescence jet manifold 32 and filament exit guide 34, is shown mounted at the bottom of shaft 20. The lower closure section has a cross section that converges from that of the spinning shaft to that of filament exit guide 34, which with door 36 encloses the bottom of the spin cell. Referring to FIG. 5, the yarn exit guide contains one outlet passage 35 for each filament; twenty-four outlet passages are shown.

After exiting through the exit guide, the spandex can be wound up on cores to form packages.

What is claimed is:

1. A spinning cell for dry-spinning spandex comprising:

(A) a substantially rectangular, adiabatically controlled shaft;

(B) a top plenum in a wall of the shaft for providing a cross-flow of hot inert gas; and (C) a substantially rectangular bar containing groups of spinneret capillaries mounted atop the shaft and having short axis, a long axis, and a nonuniform array of spinneret capillary groups in which a first row and a second row of capillary groups are in staggered relationship to each other, the first row being closer to the top plenum than the second row, wherein the capillary groups in each row deviate from a uniform linear arrangement in that:

(i) the first row comprises two more capillary groups than the second row;

(ii) the second row is divided into two segments by omitting one capillary group therein adjacent to the short axis of the bar;

(iii) at least two of the capillary groups at each end of the first row are offset toward the long axis of the bar;

(iv) at least one capillary group at each end of the second row is offset toward the long axis of the bar; and (v) at least one capillary group at each end of the first row is offset toward the short axis of the bar.

2. The spinning cell of claim 1 wherein within each group of capillaries the distance of one capillary from other capillaries within each group is shortest in the groups of capillaries at each end of the first row and the second row, intermediate in the groups of capillaries in the mid-section of the first row and longest in the groups of capillaries in the mid-section of the second row.

3. The spinning cell of claim 2 further comprising:

a vacuum plenum in the shaft wall for withdrawing gas;

a closure section comprising a filament exit guide and enclosing a bottom of the shaft; and a bottom plenum in the shaft wall above the closure section and below the vacuum plenum for providing an up-flow of cooler inert gas.

4. The spinning cell of claim 3 further comprising a heat shield mounted in spaced relationship from the face of the bar.

5. A method for dry-spinning spandex comprising the steps of:

(a) pumping a heated solution containing polyurethane through a nonuniform array of spinneret capillary groups in a substantially rectangular bar to extrude filaments;

(b) contacting the extruded filaments with a cross-flow of hot, inert gas introduced through a top plenum into an upper portion of an adiabatically controlled, substantially rectangular shaft;

(c) removing the filaments through an exit guide at the bottom of the shaft; and (d) winding the spandex on cores to form packages;

wherein the bar contains groups of spinneret capillaries and is mounted atop the shaft and has a short axis, a long axis, and a nonuniform array of spinneret capillary groups in which a first row and a second row of capillary groups are in staggered relationship to each other, the first row being closer to the top plenum than the second row, wherein the capillary groups in each row deviate from a uniform linear arrangement in that:

(i) the first row comprises two more capillary groups than the second row;

(ii) the second row is divided into two segments by omitting one capillary group therein adjacent to the short axis of the bar;

(iii) at least two of the capillary groups at each end of the first row are offset toward the long axis of the bar;

(iv) at least one capillary group at each end of the second row is offset toward the long axis of the bar; and (v) at least one capillary group at each end of the first row is offset toward the short axis of the bar.

6. The method of claim 5 wherein within each group of capillaries the distance of one capillary from other capillaries within each group is shortest in the groups of capillaries at each end of the first row and the second row, intermediate in the groups of capillaries in the mid-section of the first row and longest in the groups of capillaries in the mid-section of the second row.

7. The method of claim 6 comprising the further steps of:

withdrawing gas through a vacuum plenum in a shaft wall; and providing an up-flow of cooler inert gas through a bottom plenum in the shaft wall above a closure section and below the vacuum plenum.

8. The method of claim 7 wherein a heat shield is mounted in spaced relationship from the face of the spinneret bar.

* * * * *